US011725410B2

(12) United States Patent
Chen

(10) Patent No.: US 11,725,410 B2
(45) Date of Patent: Aug. 15, 2023

(54) ELECTRIC POOL-CLEANING ROBOT

(71) Applicant: NingBo Poolstar Pool Products Co., Ltd, Zhejiang (CN)

(72) Inventor: Liang Chen, Zhejiang (CN)

(73) Assignee: NingBo Poolstar Pool Products Co., Ltd, Ningbo (CN)

( * ) Notice: Subject to any disclaimer, the term of this patent is extended or adjusted under 35 U.S.C. 154(b) by 42 days.

(21) Appl. No.: 17/400,489

(22) Filed: Aug. 12, 2021

(65) Prior Publication Data

US 2022/0018149 A1 Jan. 20, 2022

(30) Foreign Application Priority Data

Aug. 14, 2020 (CN) ..... 202021696583.3

(51) Int. Cl.
*E04H 4/16* (2006.01)

(52) U.S. Cl.
CPC ..... *E04H 4/1663* (2013.01); *E04H 4/16* (2013.01)

(58) Field of Classification Search
CPC ..... E04H 4/16; E04H 4/1663
See application file for complete search history.

(56) References Cited

U.S. PATENT DOCUMENTS

| | | | | |
|---|---|---|---|---|
| 9,896,858 | B1 | 2/2018 | Hayes et al. | |
| 10,094,130 | B2 * | 10/2018 | Erlich | E04H 4/1636 |
| 2010/0306931 | A1 * | 12/2010 | Garti | E04H 4/1654 210/232 |
| 2020/0095792 | A1 * | 3/2020 | Miller | E04H 4/1654 |

FOREIGN PATENT DOCUMENTS

| | | | |
|---|---|---|---|
| CN | 205001530 | U | 1/2016 |
| CN | 110107123 | A | 8/2019 |

* cited by examiner

*Primary Examiner* — Michael D Jennings

(57) ABSTRACT

An electric pool-cleaning robot, including a housing, a first filtering mechanism and a rotating wheel. One end of the housing is provided with a first water inlet, and the other end of the housing is provided with a first water outlet. The first filtering mechanism is arranged in the housing. The water enters the housing through the first water inlet, and then flows toward the first filtering mechanism to be filtered. The filtered water flows out of the housing through the first water outlet. The rotating wheel is arranged on the housing, and is capable of rotating to drive the housing to move.

6 Claims, 5 Drawing Sheets

ELECTRIC POOL-CLEANING ROBOT

CROSS-REFERENCE TO RELATED APPLICATIONS

This application claims the benefit of priority from Chinese Patent Application No. 202021696583.3, filed on Aug. 14, 2020. The content of the aforementioned application, including any intervening amendments thereto, is incorporated herein by reference in its entirety.

TECHNICAL FIELD

This application relates to robots, and more particularly to an electric pool-cleaning robot.

BACKGROUND

The existing pool cleaner can only filter the water therearound. Generally, it is required to manually move the pool cleaner to achieve the filtering of the water at different positions, which is laborious and inconvenient.

SUMMARY

In view of this, an object of this application is to provide a movable electric pool-cleaning robot.

To achieve the above object, this application provides an electric pool-cleaning robot, comprising:

a housing;

a first filtering mechanism; and a rotating wheel;

wherein one end of the housing is provided with a first water inlet, and the other end of the housing is provided with a first water outlet; the first filtering mechanism is arranged in the housing; water to be treated flows into the housing through the first water inlet, and then flows toward the first filtering mechanism to be filtered to obtain filtered water; the filtered water flows out of the housing through the first water outlet; the rotating wheel is arranged on the housing; and the rotating wheel is capable of rotating to drive the housing to move.

In an embodiment, the first filtering mechanism comprises a support cylinder and a filter cartridge; wherein the filter cartridge is arranged around an outer circumference of the support cylinder; the support cylinder is arranged in the housing; the outer circumference of the support cylinder is provided with a second water inlet; an end of the support cylinder facing toward the first water outlet is provided with a second water outlet; the water to be treated passes through the first water inlet to enter the housing and then flows toward the filter cartridge to be filtered; and the filtered water enters into the support cylinder through the second water inlet, and then flows out of the housing through the second water outlet and the first water outlet.

In an embodiment, the electric pool-cleaning robot further comprises a second filtering mechanism; wherein the second filtering mechanism is arranged in the housing, and located between the first filtering mechanism and the first water inlet; the water to be treated enters into the housing through the first water inlet and flows toward the second mechanism structure to be filtered by the second mechanism structure and the first filtering mechanism in sequence, and then flows out of the housing through the first water outlet.

In an embodiment, the second filtering mechanism comprises a base frame and a filter screen; where the filter screen is arranged on the base frame; the base frame is arranged in the housing; the water to be treated enters into the housing through the first water inlet and flows toward the filter screen to be filtered by the filter screen and the first filtering mechanism in sequence, and then flows out of the housing through the first water outlet.

In an embodiment, the electric pool-cleaning robot further comprises a first limiting part; wherein the first limiting part is arranged in the housing; and the base frame and the first filtering mechanism are sleeved on the first limiting part to position the base frame and the first filtering mechanism in the housing.

In an embodiment, the electric pool-cleaning robot further comprises an impeller assembly; wherein the impeller assembly is arranged on the housing; and the impeller assembly is configured to drive water flowing out of the housing to rotate to accelerate water discharge.

In an embodiment, the electric pool-cleaning robot further comprises a volute casing; wherein the volute casing is arranged at the first water outlet of the housing; the impeller assembly is arranged in the volute casing; the volute casing is provided with a third water outlet; the impeller assembly is capable of driving water entering the volute casing to rotate to accelerate discharge of the water in the volute casing to an outside of the volute casing through the third water outlet, so as to generate a force that is opposite to an outflow direction of the water and is used to drive the rotating wheel to rotate.

In an embodiment, the volute casing is rotatably arranged at the first water outlet of the housing; and the volute casing is capable of rotating relative to the housing, so that an angle of the third water outlet of the volute casing relative to the housing is adjustable to enable water to be discharged to the outside of the volute casing through the third water outlet at different angles.

In an embodiment, the electric pool-cleaning robot further comprises a driving part; wherein the driving part is arranged in the housing; the driving part is provided with a driving shaft; the driving shaft passes through the housing and partially extends into the volute casing to be connected to the impeller assembly; the driving part is configured to drive the impeller assembly to rotate around an axial direction of the driving shaft through rotation of the driving shaft; the impeller assembly is configured to drive the water entering the volute casing to rotate to drive the volute casing to rotate, so that the angle of the third water outlet of the volute casing relative to the housing is adjustable.

In an embodiment, the driving shaft is capable of rotating forwardly and reversely.

The beneficial effects of the present disclosure are described below.

The water to be treated enters into the housing through the first water inlet and flows toward the first filtering mechanism to be filtered, and flows out of the housing through the first water outlet to achieve the water filtration. In this solution, the rotating wheel can drive the housing to move through rotation, so that the electric pool-cleaning robot can filter the water at different positions. The electric pool-cleaning robot provided in this disclosure does not need to be moved manually, which is more convenient and labor-saving.

BRIEF DESCRIPTION OF THE DRAWINGS

In order to more clearly describe the technical solutions in the embodiments of the present application or the prior art, drawings that need to be used in the description of the embodiments or the prior art will be briefly introduced below. Obviously, presented in the drawings are only some embodiments of the present disclosure. For those skilled in the art, other drawings can be obtained according to the drawings provided herein without paying creative effort.

Figure 1:
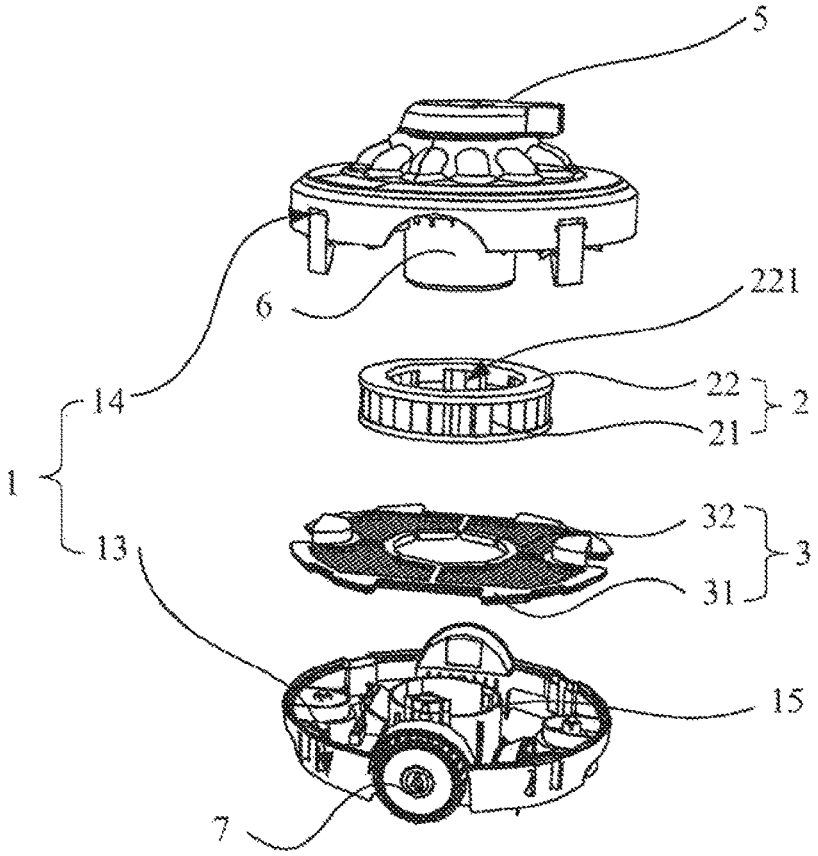
FIG. 1 is an exploded view of an electric pool-cleaning robot according to an embodiment of this disclosure.

In the drawings, 1, housing; 11, first water inlet; 12, first water outlet; 13, first housing structure; 14, second housing structure; 15, first limiting part; 16, liquid inlet channel; 17, second limiting part; 171, forward-rotation limiting block; 172. reverse-rotation limiting block; 2, first filtering mechanism; 21, support cylinder; 22, filter cartridge; 221, second water outlet; 3, second filtering mechanism; 31, base frame; 32, filter screen; 4, impeller assembly; 41, upper cover; 42, lower cover; 43, blade; 431, hinged end; 432, swing end; 44, retaining rib; 5, volute casing; 51, third water outlet; 52, upper casing; 521, baffle; 53, lower casing; 531, third water inlet; 6, driving part; 61, driving shaft; and 7, rotating wheel.

The technical solutions, functional characteristics, and advantages of this application will be further described below with reference to the embodiments and drawings.

DETAILED DESCRIPTION OF EMBODIMENTS

The technical solutions of the present application will be clearly and completely described below with reference to the drawings and embodiments. Obviously, described below are only some embodiments of the present application, and not intended to limit the disclosure. Based on the embodiments provided herein, other embodiments obtained by those skilled in the art without paying any creative effort shall fall within the scope of this application.

It should be noted that as used herein, all directional indicators (such as up, down, left, right, front, back, etc.) in the embodiments of this application are only used to explain the relative position relationship and movement situation between components in a particular posture (as shown in the drawings). If the particular posture changes, the directional indication will change accordingly. In addition, the terms "first", "second", etc. in this application are only descriptive and can not be understood as indicating or implying relative importance or the number of technical features referred to. Therefore, the features defined with "first" and "second" may explicitly or implicitly include at least one of the features. In addition, as used herein, the "and/or" includes three solutions, for example, the "A and/or B" includes A, B, and a combination of A and B. In addition, the technical solutions of various embodiments can be combined as long as the combined technical solution can be implemented by those skilled in the art. When the combination of technical solutions is contradictory or cannot be achieved, it should be considered that such a combination of technical solutions does not exist, and does not fall into the scope of this application defined by the appended claims.

The specific structure of the electric pool-cleaning robot will be described in detail below.

Figure 3:
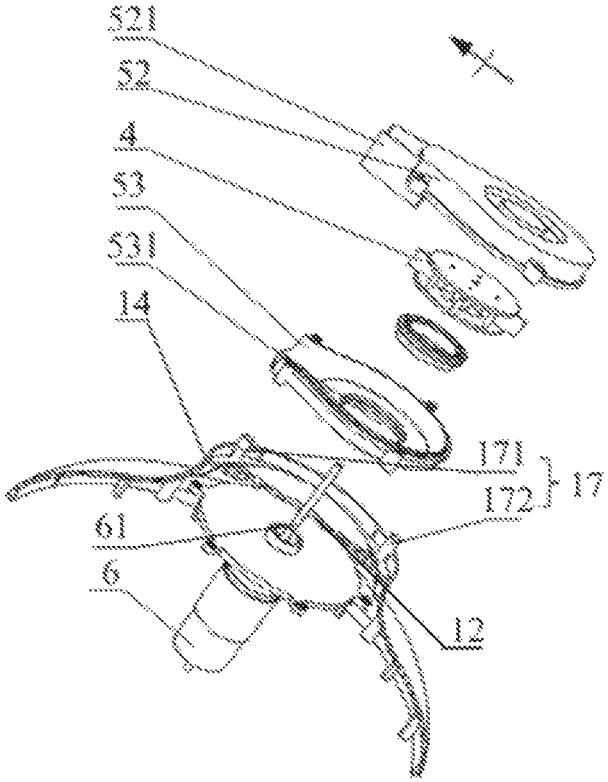
FIG. 3 is an exploded view of a second housing structure and a turbine assembly according to an embodiment of this disclosure.
Figure 9:
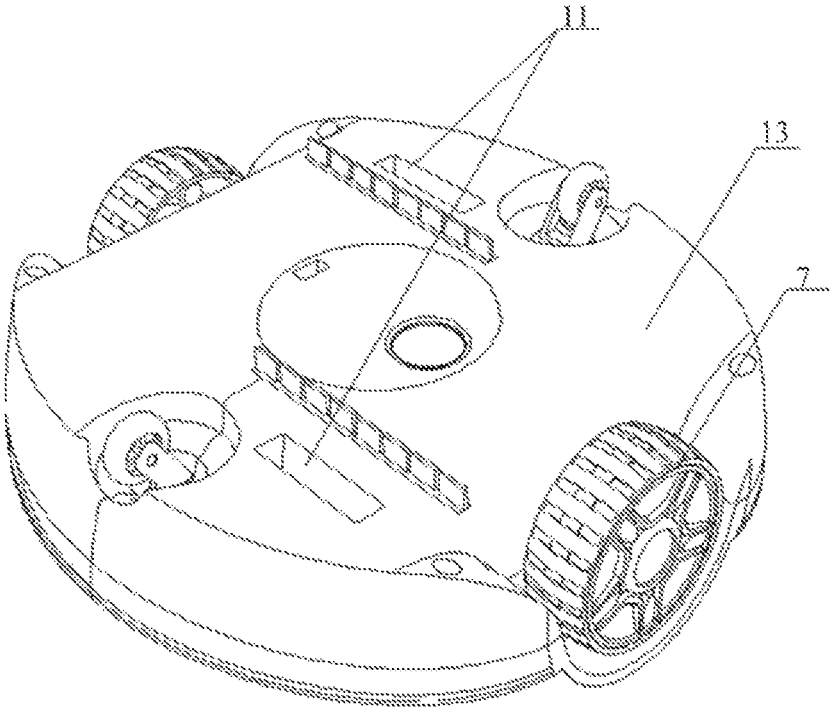
FIG. 9 schematically illustrates a structure of a first housing structure according to an embodiment of this disclosure.

As shown in FIGS. 1, 3 and 9, an embodiment of the disclosure provides an electric pool-cleaning robot, including a housing 1, a first filtering mechanism 2, and a rotating wheel 7. One end of the housing 1 is provided with a first water inlet 11, and the other end of the housing 1 is provided with a first water outlet 12. The first filtering mechanism 2 is arranged in the housing. The water to be treated flows into the housing 1 through the first water inlet 11, and then flows toward the first filtering mechanism 2 to be filtered to obtain filtered water. The filtered water flows out of the housing 1 through the first water outlet 12. The rotating wheel 7 is arranged on the housing 1. The rotating wheel 7 is capable of rotating to drive the housing 1 to move.

The water to be treated flows into the housing 1 through the first water inlet 11 and flow toward the first filtering mechanism 2 to be filtered, and then flows out of the housing 1 through the first water outlet 12 to achieve the water filtration. In this embodiment, the rotating wheel 7 can drive the housing 1 to move through rotation, so that the electric pool-cleaning robot can filter the water at different positions. The electric pool-cleaning robot provided in this disclosure does not need to be moved manually, which is more convenient and labor-saving.

As shown in FIG. 1, the housing 1 includes a first housing structure 13 and a second housing structure 14. The second housing structure 14 is arranged on the first housing structure 13.

Figure 2:
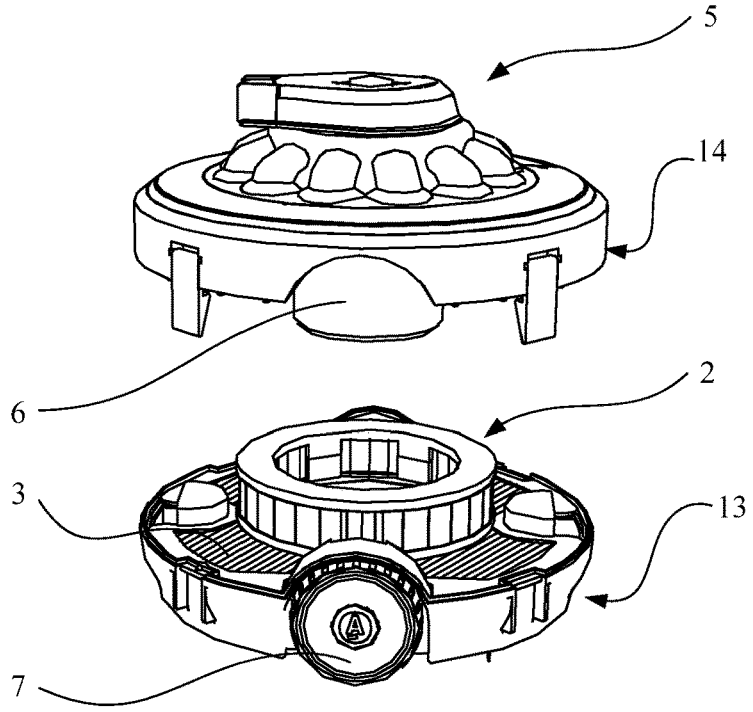
FIG. 2 is another exploded view of the electric pool-cleaning robot according to an embodiment of this disclosure.

As shown in FIGS. 1-3, the first filtering mechanism 2 includes a support cylinder 21 and a filter cartridge 22. The filter cartridge 22 is arranged around an outer circumference of the support cylinder 21. The support cylinder 21 is arranged in the housing 1. The outer circumference of the support cylinder 21 is provided with a second water inlet. An end of the support cylinder 21 facing toward the first water outlet 12 is provided with a second water outlet 221. The water to be treated passes through the first water inlet 11 to enter the housing 1, and then flows toward the filter cartridge 22 to be filtered. The filtered water enters into the support cylinder 21 through the second water inlet, and then flows out of the housing through the second water outlet 221 and the first water outlet 12. Specifically, the filter cartridge 22 can be but not limited to a hollow cylinder. It should be understood that in some embodiments, the filter cartridge 22 can be arranged around the inner circumference to be supported. In some embodiments, if the filter cartridge 22 has enough strength, it is not necessary to introduce the support cylinder 21 to support the filter cartridge 22.

As shown in FIG. 1, the electric pool-cleaning robot further includes a second filtering mechanism 3. The second filtering mechanism 3 is arranged in the housing, and located between the first filtering mechanism 2 and the first water inlet 11. The water to be treated enters into the housing 1 through the first water inlet 12 and flows toward the second filtering mechanism 3 to be filtered by the second filtering mechanism 3 and the first filtering mechanism 2 in sequence, and then flows out of the housing 1 through the first water outlet 12. Specifically, the first filtering mechanism 2 is arranged on the second filtering mechanism 3.

As shown in FIG. 1, the second filtering mechanism 3 includes a base frame 31 and a filter screen 32. The filter screen 32 is arranged on the base frame 31. The base frame 31 is arranged in the housing 1. The water to be treated enters into the housing 1 through the first water inlet 11 and flows toward the filter screen 32 to be filtered by the filter screen 32 and the first filtering mechanism 2 in sequence, and then flows out of the housing 1 through the first water outlet 12. Specifically, the water to be treated is filtered by the filter screen 32 and the first filtering mechanism 2 in sequence, and then flows out of the housing 1 through the first water outlet 12.

As shown in FIGS. 1-2, the electric pool-cleaning robot further includes a first limiting part 15. The first limiting part 15 is arranged in the housing 1. The base frame 31 and the first filtering mechanism 2 are sleeved on the first limiting part 15 to position the base frame 31 and the first filtering mechanism 2 in the housing 1. Specifically, the base frame 31 and the support cylinder 21 are sleeved on the first limiting part 15. The first limiting part 15 is arranged in the first housing structure 13. The first limiting part 15 can be but not limited to a hollow cylinder.

As shown in FIGS. 1 and 3, the electric pool-cleaning robot further includes an impeller assembly 4. The impeller assembly 4 is arranged on the housing 1. The impeller assembly 4 is capable of driving water flowing out of the housing 1 to rotate to accelerate the discharge of the water.

As shown in FIGS. 1 and 3, the electric pool-cleaning robot further includes a volute casing 5. The volute casing 5 is arranged at the first water outlet 12 of the housing 1. The impeller assembly 4 is arranged in the volute casing 5. The volute casing 5 is provided with a third water outlet 51. The impeller assembly 4 is capable of driving water entering into the volute casing 5 to rotate to accelerate discharge of the water in the volute casing 5 to an outside of the volute casing 5 through the third water outlet, so as to generate a force that is opposite to an outflow direction of the water and is used to drive the rotating wheel 7 to rotate.

Figure 4:
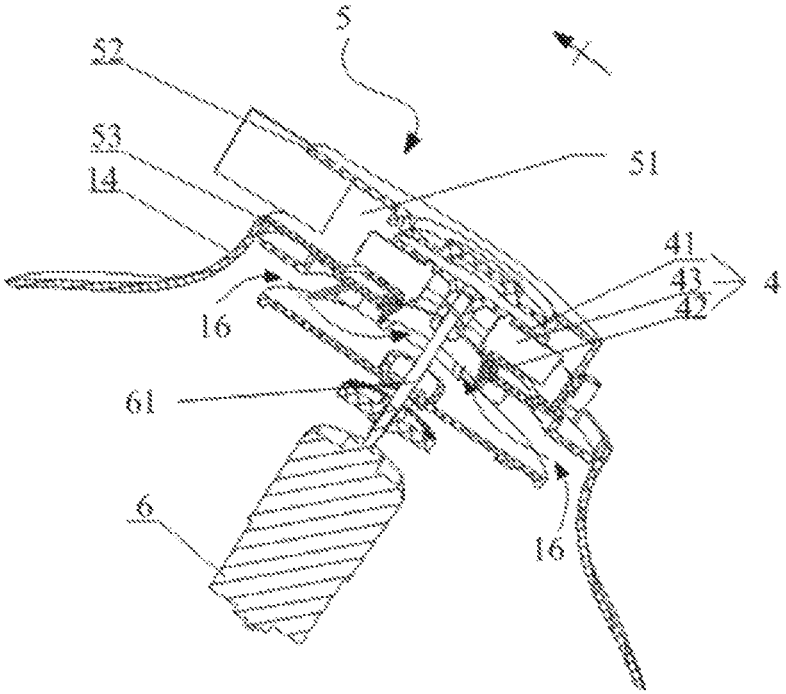
FIG. 4 is a cross-sectional view of the second housing structure and the turbine assembly according to an embodiment of this disclosure.

As shown in FIG. 4, a liquid inlet channel 16 is arranged in the second housing structure 14, and is communicated with an interior of the volute casing 5.

The volute casing 5 is rotatably arranged at the first water outlet 12 of the housing 1. The volute casing 5 is capable of rotating relative to the housing 1, so that an angle of the third water outlet 51 of the volute casing 5 relative to the housing 1 is adjustable to enable the water to be discharged to the outside of the volute casing 5 through the third water outlet 51 at different angles.

As shown in FIG. 3, a second limiting part 17 is arranged in the second housing structure 14. The second limiting part 17 can limit a rotation angle of the volute casing 5.

As shown in FIG. 3, the second limiting part 17 provided in an embodiment at least includes a forward-rotation limiting block 171 and a reverse-rotation limiting block 172. The forward-rotation limiting block 171 is configured to limit the third water outlet 51 facing toward the direction that is opposite to the direction indicated by the arrow in FIG. 3. The reverse-rotation limiting block 172 is configured to limit the third water outlet 51 facing toward the direction indicated by the arrow in FIG. 3.

As shown in FIGS. 3-4, the electric pool-cleaning robot further includes a driving part 6. The driving part 6 is arranged in the housing 1. The driving part 6 is provided with a driving shaft 61. The driving shaft 61 passes through the housing 1 and partially extends into the volute casing 5 to be connected to the impeller assembly 4. The driving part 6 is configured to drive the impeller assembly 4 to rotate around an axial direction of the driving shaft 61 through a rotation of the driving shaft 61. The impeller assembly 4 is configured to drive water entering the volute casing 5 to rotate to drive the volute casing 5 to rotate, so that the angle of the third water outlet 51 of the volute casing 5 relative to the housing 1 is adjustable.

As shown in FIGS. 3-4, the drive shaft 61 is configured to drive the impeller assembly 4 and the volute casing 5 to rotate. When the volute casing 5 rotates to the second limiting part 17, the volute casing 5 is restricted and cannot continue to rotate, thereby determining an orientation of the third water outlet 51. The water is accelerated by the impeller assembly 4 to be discharged from the third water outlet 51 to generate a force that is opposite to an outflow direction of the water and is used to drive the rotating wheel 7 to rotate. The force drives the rotating wheel 7 to rotate to drive the housing 1 to move.

The drive shaft 61 can rotate forwardly and reversely. Through switching the rotation direction of the drive shaft 61, the rotation direction of the impeller assembly 4 can be changed. The impeller assembly 4 drives the water in the volute casing 5 to rotate to drive the volute casing 5 to rotate in another direction. The volute casing 5 is restricted and cannot continue to rotate when it rotates to the second limiting part 17, which determines another direction of the third water outlet 51 to produce a force that is opposite to an outflow direction and is used to drive the rotating wheel 7 to rotate. The force drives the rotating wheel 7 to rotate to drive the housing 1 to move toward another direction.

Figure 5:
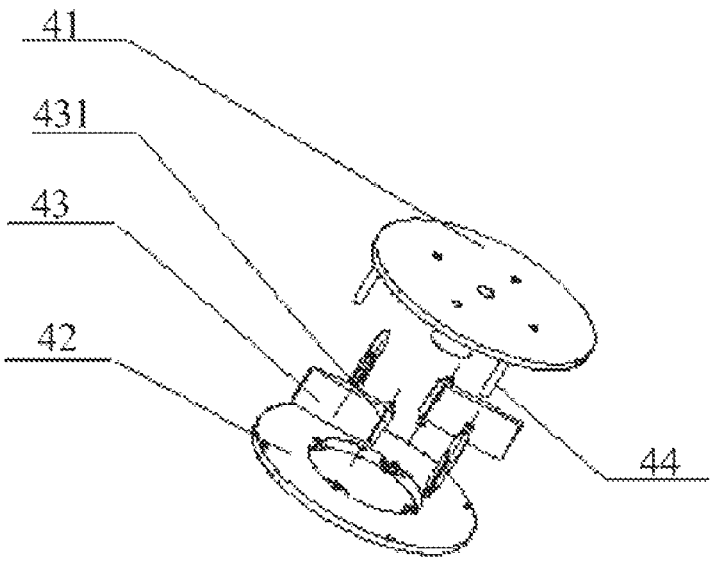
FIG. 5 is an exploded view of an impeller assembly according to an embodiment of this disclosure.

As shown in FIG. 5, the impeller assembly 4 includes an upper cover 41, a lower cover 42, and a plurality of blades 43 arranged between the upper cover 41 and the lower cover 42.

Figure 6:
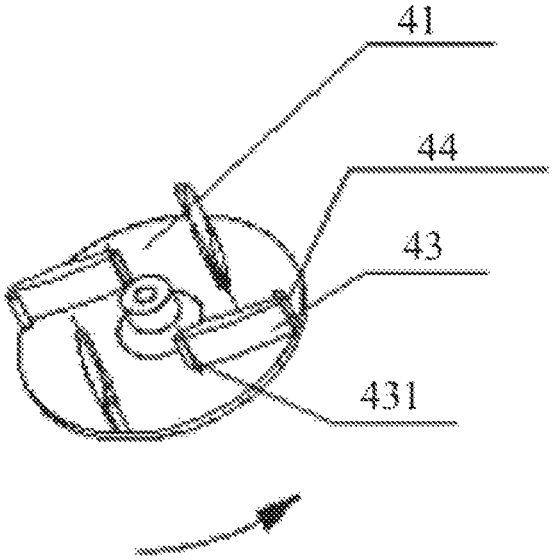
FIG. 6 schematically shows swing of a blade according to an embodiment of this disclosure in one direction.
Figure 7:
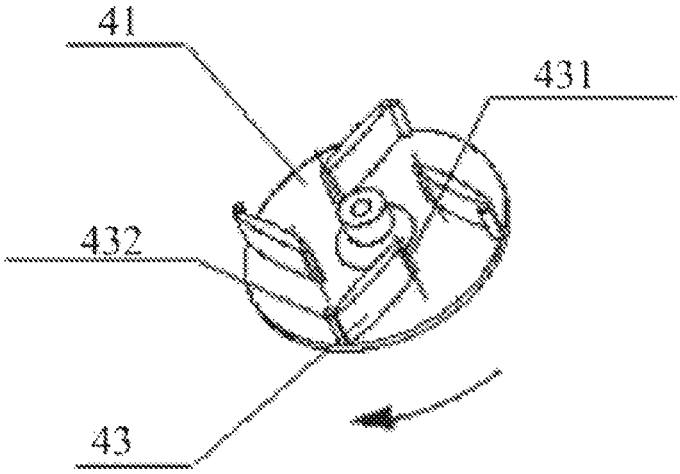
FIG. 7 schematically shows the swing of the blade according to an embodiment of this disclosure in another direction.
Figure 8:
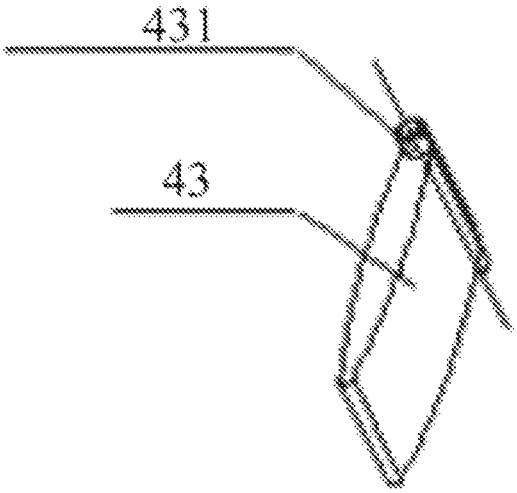
FIG. 8 schematically illustrates a structure of the blade according to an embodiment of this disclosure.

As shown in FIGS. 5-7, each blade 43 has a hinged end 431 and a swing end 432. The hinged end 431 is hinged to the upper cover 41 and/or the lower cover 42. The impeller assembly 4 further includes a plurality of retaining ribs 44 mounted on the upper cover 41 and/or the lower cover 42, configured to restrict the position of the swing end 432. Specifically, the blade 43 swings with the hinge end 431 as the center after being impacted by the water, and after the swing end 432 abuts against the corresponding retaining rib 44, the swinging of the swing end 432 stops, thereby forming a fixed angle.

As shown in FIG. 6, when the impeller assembly 4 rotates clockwise, individual blade 43 is impacted by the water and swings in the direction indicated by the arrow until it abuts against the corresponding retaining ribs 44. Correspondingly, as shown in FIG. 7, when the impeller assembly 4 rotates counterclockwise, individual blade 43 is impacted by the water and swings in the direction indicated by the arrow until it abuts against another rib 44. Therefore, the impeller assembly 4 in this embodiment can automatically adjust an angle of individual blade 43 according to the direction of rotation, so as to adapt to the water and improve work efficiency. Specifically, if the retaining rib 44 is not provided, the rotation angle of the blade 43 is 360°. In this embodiment, adjacent two retaining ribs 44 limit the swing angle range of the corresponding blade 43 to 90°-160°.

As shown in FIG. 3, the volute casing 5 includes an upper casing 52 and a lower casing 53. The lower casing 53 is rotatably arranged on the second housing structure 14, and is provided with a third water inlet 531 configured to communicate with the liquid inlet channel 16. The upper casing 52 is provided with the third water outlet 51, and a baffle 521 is provided at the liquid outlet to enhance the water impact.

The volute casing 5 is detachably mounted on the second housing structure 14 for easy replacement.

Referring to FIGS. 1-8, the coordination and action processes of the various mechanisms are described as follows.

The water to be treated enters into the housing 1 through the first water inlet 11 and flows toward the first filtering mechanism 2 to be filtered through the filter screen 32 of the second filtering mechanism 3 and the filter cartridge 22 of the first filtering mechanism 2 in sequence. The water enters into the volute casing 5 through the first water outlet 12, the liquid inlet channel 16 and the third water inlet 531. The driving part 6 is configured to drive the impeller assembly 4 to rotate to drive the water entering into the volute casing 5 to rotate to accelerate discharge of the water in the volute casing 5 to an outside of the volute casing 5 through the third water outlet 51, so as to generate a force that is opposite to an outflow direction of the water and is used to drive the rotating wheel 7 to rotate. The force drives the rotating wheel 7 to rotate to drive the housing 1 to move. According to the requirements, the rotation direction of the driving part 6 can be changed, and thereby changing the rotation direction of the impeller assembly 4. The impeller assembly 4 drives the water in the volute casing 5 to rotate to drive the volute casing 5 to rotate in the second direction to change the orientation of the third water outlet 51. The water is accelerated to discharge out of the volute casing 5 from the third water outlet 51 facing toward the second direction to drive the housing 1 to move in the second direction, thereby realizing the change of the movement direction of the electric pool-cleaning robot.

Described above are only preferred embodiments of this application, which are not intended to limit the scope of this application. It should be understood that any variations, modifications and replacements made by those skilled in the art without departing from the spirit of the disclosure should fall within the scope of the disclosure defined by the appended claims.

What is claimed is:

1. An electric pool-cleaning robot, comprising:

a housing;

a first filtering mechanism; and a rotating wheel;

wherein one end of the housing is provided with a first water inlet, and the other end of the housing is provided with a first water outlet; the first filtering mechanism is arranged in the housing; water to be treated flows into the housing through the first water inlet, and then flows toward the first filtering mechanism to be filtered to obtain filtered water; the filtered water flows out of the housing through the first water outlet; the rotating wheel is arranged on the housing; and the rotating wheel is capable of rotating to drive the housing to move; and wherein the first filtering mechanism comprises a support cylinder and a filter cartridge; the filter cartridge is arranged around an outer circumference of the support cylinder; the support cylinder is arranged in the housing; the outer circumference of the support cylinder is provided with a second water inlet; an end of the support cylinder facing toward the first water outlet is provided with a second water outlet; the water to be treated passes through the first water inlet to enter the housing and then flows toward the filter cartridge to be filtered; and the filtered water enters into the support cylinder through the second water inlet, and then flows out of the housing through the second water outlet and the first water outlet.

2. An electric pool-cleaning robot, comprising:

a housing;

a first filtering mechanism;

a rotating wheel;

a second filtering mechanism; and a first limiting part;

wherein one end of the housing is provided with a first water inlet, and the other end of the housing is provided with a first water outlet; the first filtering mechanism is arranged in the housing; water to be treated flows into the housing through the first water inlet, and then flows toward the first filtering mechanism to be filtered to obtain filtered water; the filtered water flows out of the housing through the first water outlet; the rotating wheel is arranged on the housing; and the rotating wheel is capable of rotating to drive the housing to move;

the second filtering mechanism is arranged in the housing, and located between the first filtering mechanism and the first water inlet; the water to be treated enters into the housing through the first water inlet and flows toward the second mechanism structure, to be filtered by the second mechanism structure and the first filtering mechanism in sequence, and then flows out of the housing through the first water outlet;

the second filtering mechanism comprises a base frame and a filter screen; the filter screen is arranged on the base frame; the base frame is arranged in the housing; the water to be treated enters into the housing through the first water inlet and flows toward the filter screen to be filtered by the filter screen and the first filtering mechanism in sequence, and then flows out of the housing through the first water outlet; and wherein the first limiting part is arranged in the housing; and the base frame and the first filtering mechanism are sleeved on the first limiting part to position the base frame and the first filtering mechanism in the housing.

3. An electric pool-cleaning robot, comprising:

a housing;

a first filtering mechanism;

a rotating wheel;

an impeller assembly; and a volute casing;

wherein one end of the housing is provided with a first water inlet, and the other end of the housing is provided with a first water outlet; the first filtering mechanism is arranged in the housing; water to be treated flows into the housing through the first water inlet, and then flows toward the first filtering mechanism to be filtered to obtain filtered water; the filtered water flows out of the housing through the first water outlet; the rotating wheel is arranged on the housing; and the rotating wheel is capable of rotating to drive the housing to move;

the impeller assembly is arranged on the housing; and the impeller assembly is configured to drive water flowing out of the housing to rotate to accelerate water discharge; and wherein the volute casing is arranged at the first water outlet of the housing; the impeller assembly is arranged in the volute casing; the volute casing is provided with a third water outlet; the impeller assembly is capable of driving water entering the volute casing to rotate to accelerate discharge of the water in the volute casing to an outside of the volute casing through the third water outlet, so as to generate a force that is opposite to an outflow direction of the water and is used to drive the rotating wheel to rotate.

4. The electric pool-cleaning robot of claim 3, wherein the volute casing is rotatably arranged at the first water outlet of the housing; and the volute casing is capable of rotating relative to the housing, so that an angle of the third water outlet of the volute casing relative to the housing is adjustable to enable water to be discharged to the outside of the volute casing through the third water outlet at different angles.

5. The electric pool-cleaning robot of claim 4, further comprising:

a driving part;

wherein the driving part is arranged in the housing; the driving part is provided with a driving shaft; the driving shaft passes through the housing and partially extends into the volute casing to be connected to the impeller assembly; the driving part is configured to drive the impeller assembly to rotate around an axial direction of the driving shaft through rotation of the driving shaft; the impeller assembly is configured to drive the water entering the volute casing to rotate to drive the volute casing to rotate, so that the angle of the third water outlet of the volute casing relative to the housing is adjustable.

6. The electric pool-cleaning robot of claim 5, wherein the driving shaft is capable of rotating forwardly and reversely.

* * * * *